US005294177A

United States Patent [19]

Rasnick et al.

[11] Patent Number: 5,294,177

[45] Date of Patent: Mar. 15, 1994

[54] AUTOMATIC BLOCK FOR ROCKER CHAIRS

[75] Inventors: Glen L. Rasnick; Ronald H. Cordover, both of Morristown, Tenn.

[73] Assignee: The Berkline Corporation, Morristown, Tenn.

[21] Appl. No.: 997,572

[22] Filed: Dec. 28, 1992

Related U.S. Application Data

[63] Continuation-in-part of Ser. No. 881,344, May 11, 1992, Pat. No. 5,217,277.

[51] Int. Cl.[5] ..... A47C 3/03

[52] U.S. Cl. ..... 297/270; 297/145; 297/DIG. 7

[58] Field of Search ..... 297/68, 84, 85, 140, 297/144, 145, 258, 270, 271, DIG. 7

[56] References Cited

U.S. PATENT DOCUMENTS

| | | |
|---|---|---|
| 624,812 | 5/1899 | Hunzinger . |
| 1,191,307 | 7/1916 | Hornschuch . |
| 1,726,109 | 8/1929 | Jost . |
| 1,753,423 | 4/1930 | Kroschel . |
| 1,907,322 | 5/1933 | Keicher . |
| 2,173,569 | 9/1939 | Troendle . |
| 2,500,789 | 3/1950 | Belisle . |
| 2,502,383 | 3/1950 | Loewy . |
| 2,549,286 | 4/1951 | Belisle . |
| 2,767,771 | 10/1956 | Leonard . |
| 3,042,467 | 7/1962 | Germick . |
| 3,279,847 | 10/1966 | Re . |
| 3,622,198 | 11/1971 | Re . |
| 3,637,255 | 1/1972 | Re . |
| 3,747,973 | 7/1973 | Re . |
| 3,802,735 | 4/1974 | Re . |
| 4,953,771 | 9/1990 | Fischer . |

FOREIGN PATENT DOCUMENTS

| | | |
|---|---|---|
| 2006317 | 8/1971 | Fed. Rep. of Germany . |
| 531205 | 4/1955 | Italy . |
| 217037 | 6/1924 | United Kingdom . |

*Primary Examiner*—Peter R. Brown

*Attorney, Agent, or Firm*—David D. Kaufman

[57] ABSTRACT

A rocker chair has a table concealed in an arm thereof which is extendible into an operative horizontal position. A stop block member is slidably mounted on a side base member of the chair and is moved into an operative position wherein it is effective to prevent forward and backward rocking motion when the chair is in the upright position. An actuating cable is connected between the stop block and the table and is effective to automatically move the stop block into the operative position when the table is extended. The invention can be incorporated into a rocker/recliner chair or a simple rocker chair.

13 Claims, 5 Drawing Sheets

AUTOMATIC BLOCK FOR ROCKER CHAIRS

This application is a continuation-in-part of application Ser. No. 07/881,344, filed May 11, 1992, issued as U.S. Pat. No. 5,217,277 for "Seat Arm With Concealed Table," owned by an assignee in common with the present application.

BACKGROUND OF THE INVENTION

This invention relates generally to upholstered rocker and rocker/recliner chairs and, more particularly, to a blocking device for automatically preventing rocking motion of the chair when the chair is in the upright position.

There was disclosed in the above-identified co-pending application an upholstered chair having a table concealed in a side arm thereof. The table could be opened into a substantially horizontal position and utilized to hold a drink, food, or other objects. When incorporated in a recliner chair or a stationary lounge chair, the operationally extended table remained substantially horizontal at all times, and provided stable support for any container or object carried thereon. Obviously, however, the same conditions of stability would not apply to a rocker chair and objects carried by the table would be in danger of spilling or falling therefrom. The present invention provides a means for preventing such problems when the table is incorporated in a chair having rocker capability.

Upholstered rocker chairs may be simple, capable of only a simple rocking motion; or compound, comprising a rocker/recliner having the capability of rocking and reclining. In either type of rocker chair, rocking motion is permissible only when the rocker/recliner chair is in the upright position.

Rocker/recliner chairs have long been made with means for arresting or blocking rocking motion when the chair is in a reclined position. In general, those blocking means comprise front and rear attachments to the reclining mechanism sometimes known as landing gear members. A representative example of such arresting means is disclosed in U.S. Pat. No. 3,622,198 where it will be seen that front and rear arresting members are actuated by the reclining movement of the chair and moved into operational position where they bear against the base of the chair to prevent rocking motion. When the chair is returned to the upright position, the arresting members are moved into an inoperative position so that rocking motion of the chair is permitted.

In a rocker or rocker/recliner chair equipped with a fold-out table of the type disclosed in the aforesaid co-pending application, it would be desirable to prevent rocking when the table is extended even when the chair is in the upright position. Ideally, the means for blocking rocking motion will become operational automatically when the table is extended so that inadvertent loss of or injury to articles on the table which might result from rocking of the chair is not possible.

BRIEF SUMMARY OF THE INVENTION

The present invention provides a means for blocking rocking motion of a rocker or rocker/recliner chair having a fold-out table of the type disclosed in the aforesaid co-pending application, and this invention comprises an improvement of the invention there disclosed. The blocking means is mechanically associated with the table so that rocking blockage results automatically when the table is extended.

Briefly, the invention comprises a stop block member slidably mounted on one of the side bases of the chair. The stop block is spring urged and retained in the inoperative position. The stop block is connected by cable means to the arm-concealed table so that extension of the table automatically moves the stop block into the operative position.

The stop block comprises a form having two action surfaces or portions, namely, a camming surface and an ear. The camming surface functions as a wedge between the base and its associated rocker block to prevent forward rocking motion. The ear portion of the block member cooperates with and engages the front arresting member of a conventional recliner mechanism to prevent rearward rocking motion. In the case of a simple rocker chair, the front arresting member is suitably mounted on the outer surface of the rocker block. As a result, the chair is blocked against all rocking motion when in the upright position.

When the chair occupant moves the rocker/recliner into a recline position, the recliner mechanism operates in its normal fashion. Thus, the front and rear arresting members are made operational and bear against the associated base to prevent forward and rearward rocking. If the table is already extended when the chair is reclined, the front arresting member disengages from the stop block ear and moves into bearing engagement with the base to prevent forward rocking.

Occasionally, a chair occupant could abruptly move the chair from a recline position to the upright position and quickly rise from the chair, as in the response to a doorbell or telephone ring or the like. Such abrupt movement might result in undesirable rocking motion of the unoccupied chair while the table is still extended. Such undesirable motion is prevented by the invention because operation of the chair back to the upright position causes automatic re-engagement of the ear portion of the stop block with the front arresting member.

Numerous other advantages and features of the present invention will become apparent from the following detailed description of the invention, from the claims and from the accompanying drawings.

BRIEF DESCRIPTION OF THE DRAWINGS

In the accompanying drawings forming part of the specification, and in which like numerals are employed to designate like parts throughout.

DETAILED DESCRIPTION OF THE INVENTION

In the present application, the expression "rocker chair" is used in its broadest sense and is meant to include simple rockers as well as rocker/recliners which will be illustrated and described herein. Since the linkage mechanisms and other portions of the rocker/recliner chair do not per se comprise a part of the subject invention, only so much thereof as is necessary for an understanding of the present invention will be illustrated and described. Additionally, for ease of illustration and description, only one side of the chair linkage and rocker mechanisms will be illustrated and described, although it will be understood by those skilled in the art that such elements are present on both the left and right sides of a chair.

Referring with greater particularity to the drawings, the numeral 10 indicates generally a rocker/recliner chair including pairs of conventional arcuate rocker blocks 12 and cooperating bases 14, one on each side of the chair. A table 13 is concealed in one of the chair arms and is extendible to an operative position (see FIG. 3) in the manner described in the copending application or any other suitable way.

Figure 1:
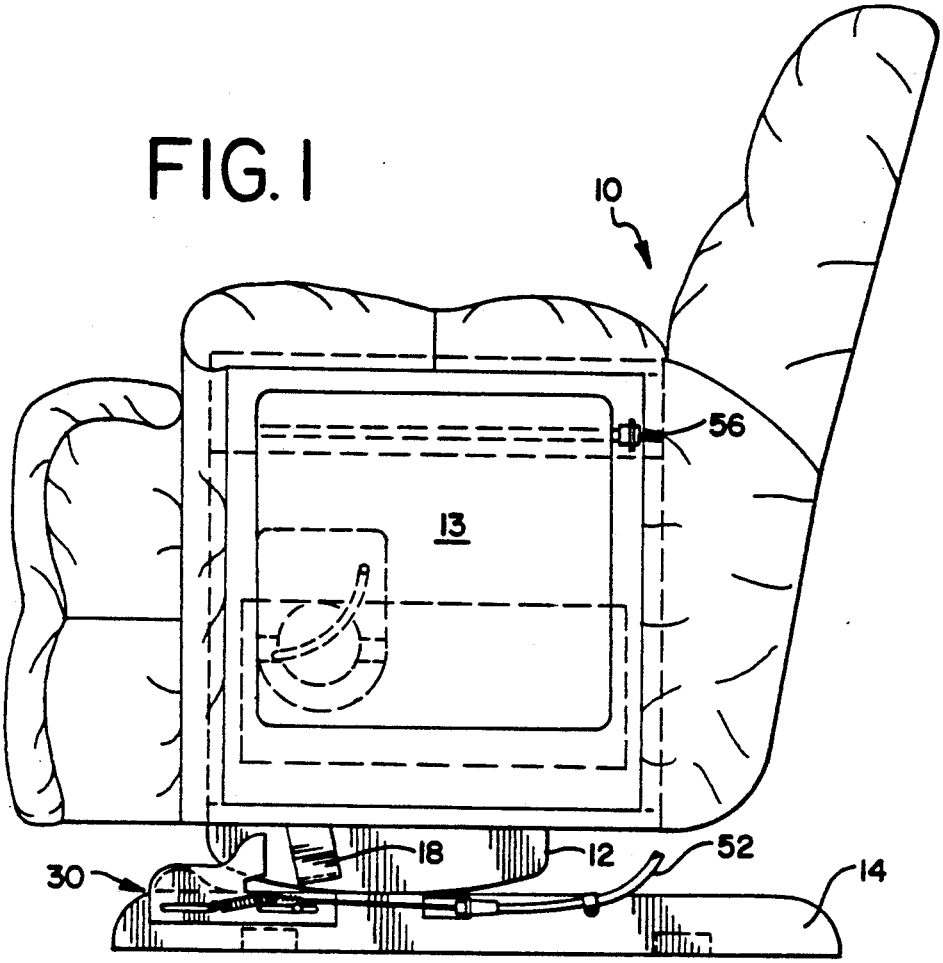
FIG. 1 is a side elevational view of a rocker/recliner chair of the type shown in co-pending application Ser. No. 07/881,344, with the outer side panel removed to show the table in the stored position.
Figure 2:
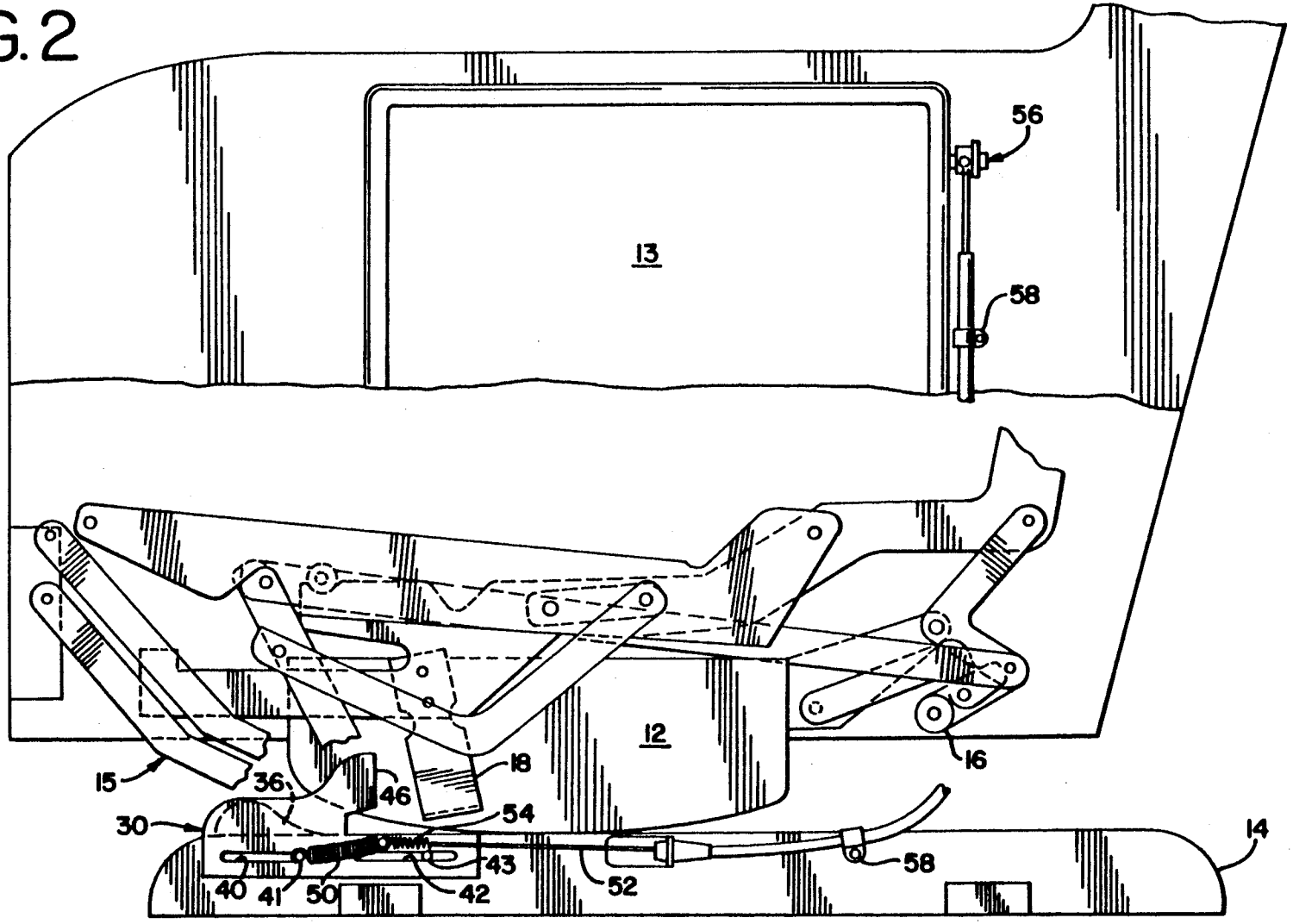
FIG. 2 is a similar view, but enlarged, and with portions broken away to show the relative positions of the stop block member of the invention and a conventional reclining mechanism with the chair in the upright position.
Figure 3:
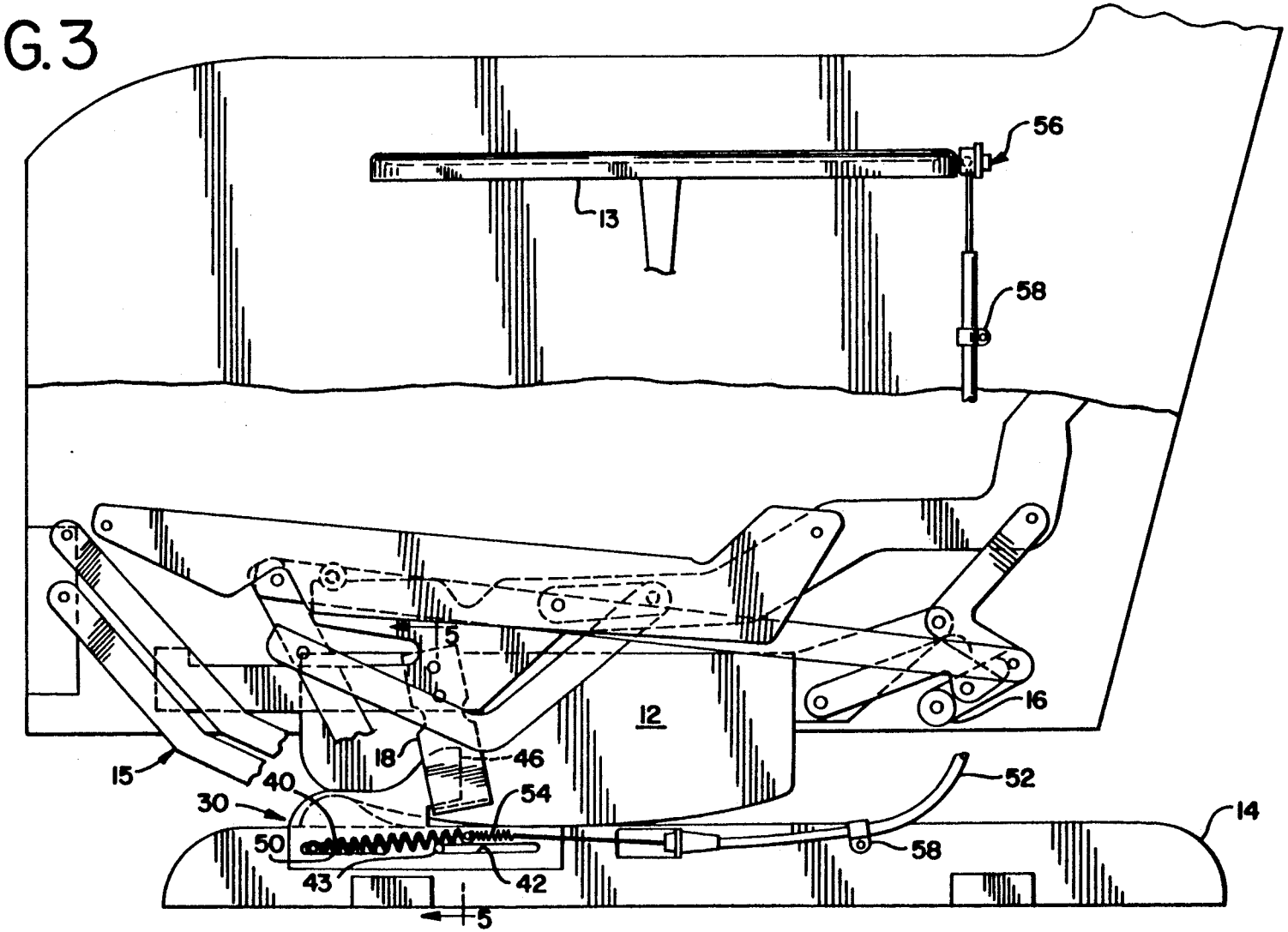
FIG. 3 is a similar view with the table in the extended position and the stop block member actuated.
Figure 4:
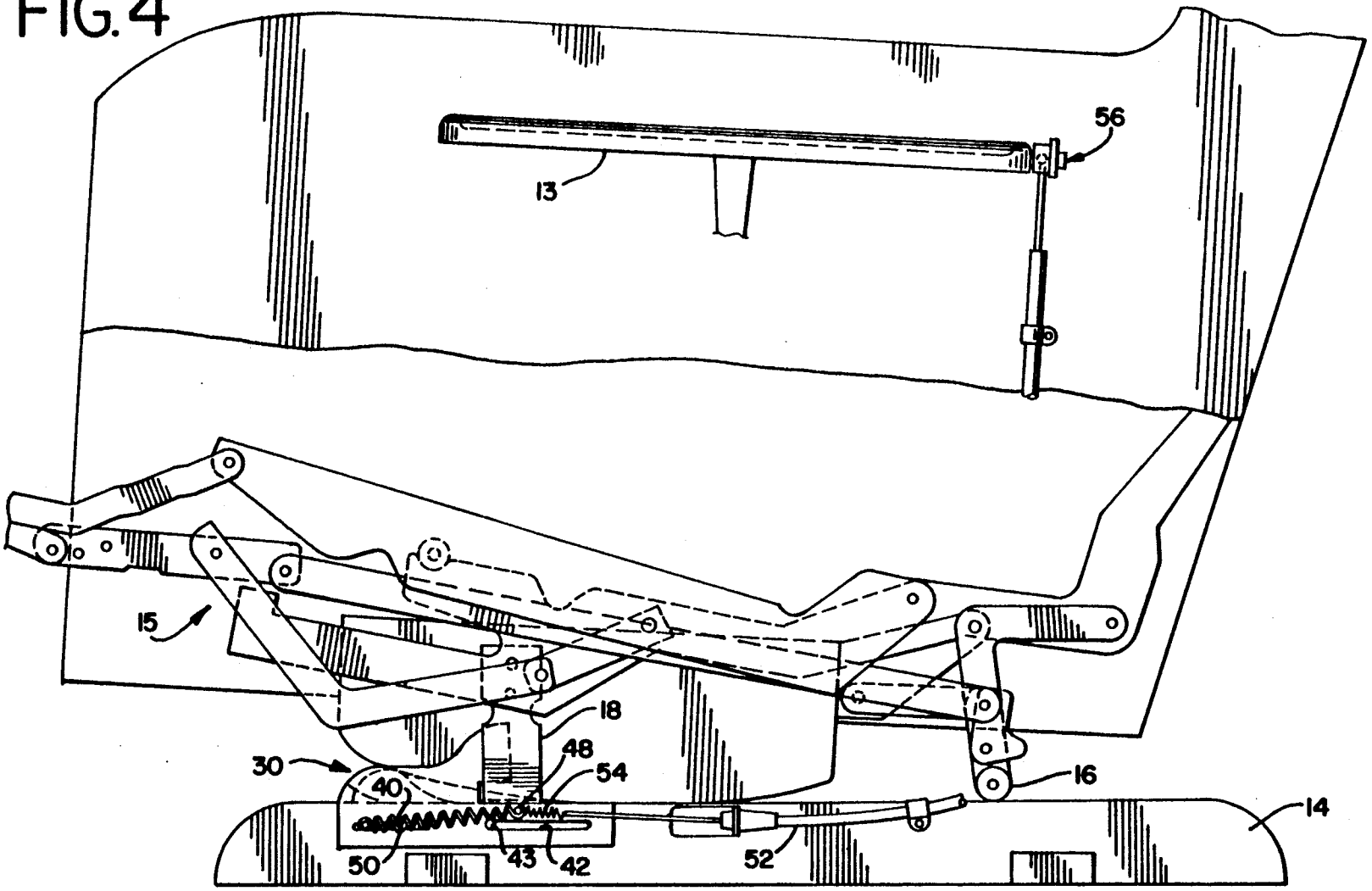
FIG. 4 is a similar view showing the relative positions of the parts when the chair is in a recline position.

Chair 10 includes a seat, a back, and a footrest which are mechanically interconnected and actuated by a conventional reclining mechanism indicated generally by the numeral 15. The mechanism 15 has a plurality of links and includes a rear arresting member 16 and a front arresting member 18, the latter preferably in the form of a depending L-shaped member 20 having a leg 22 (see FIG. 5). A linkage mechanism of this type is made by the Dual Manufacturing and Engineering division of The Berkline Corporation and is identified by the product number 27 or 29, and the mechanism may be actuated in any known manner, such as, with a handle or by pushing a button to release a spring which extends the footrest. In any case, the actuating movement of the mechanism 15 causes the arresting members 16 and 18 to move from a retracted or inactive position (FIGS. 1-3) permitting rocking motion of the rocker block 12 on the base 14, to an extended or active position wherein the same bear against the associated base 14 to prevent all rocking motion (FIG. 4). Typically, the limits of the rocking motion of the rocker block on its base are determined by a coil spring arrangement or the like (not shown), but that arrangement as well as the fragmentarily illustrated linkage mechanism are not per se a part of the present invention and thus may comprise any suitable or known structure.

Figure 5:
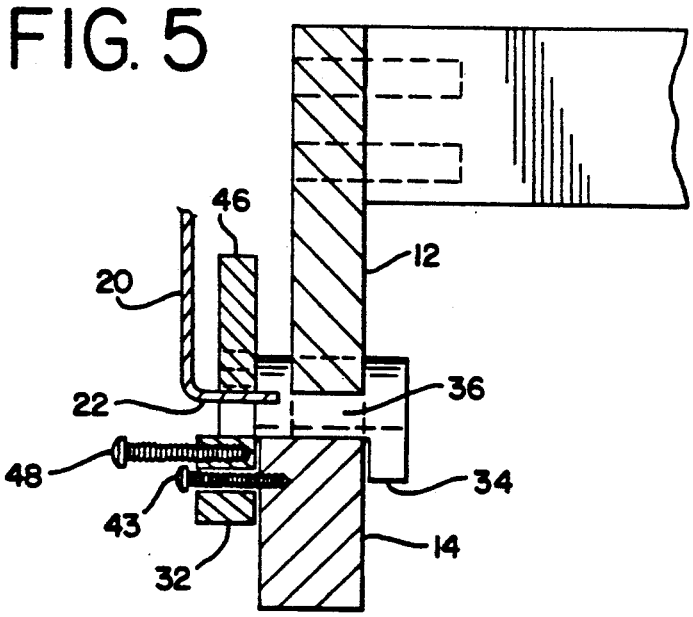
FIG. 5 is a sectional view on the plane of line 5—5 in FIG. 3.

As indicated in FIG. 5, the base 14 comprises a top or bearing surface 24, said surface being wider than the rocker block 12 resting thereon. Accordingly, when the front arresting member 18 is in the active blocking position, the bottom leg 22 thereof bears against the outwardly extending portion of the base surface 24 to prevent forward rocking motion of the chair. At the same time, the rear arresting member 16 bears against the base 24 to prevent backward rocking movement when the chair is in the reclined position. The arresting members 16 and 18 are connected to the linkage reclining mechanism 15 and movement of the arresting members from the inactive to the blocking position is caused automatically by extension of the chair footrest and/or reclination of the chair seat.

Figure 6:
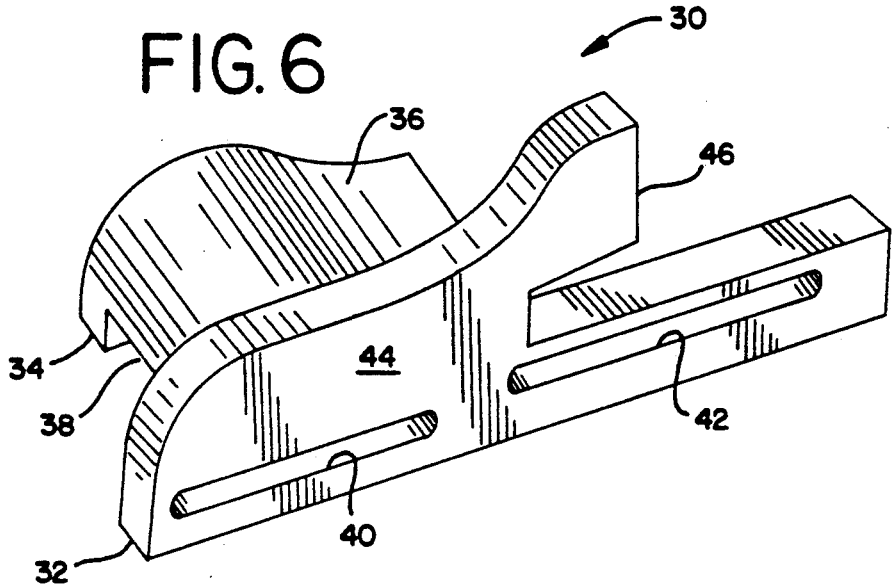
FIG. 6 is a perspective view of the stop block member.

Referring now to FIG. 6, there is illustrated a stop block 30 embodying the principles of the invention. Stop block 30 comprises an elongated outer leg 32, a short inner leg 34 and a rearwardly tapered camming surface 36 between said legs forming therewith an inverted channel 38, whereby the stop block is slidably mounted on the base 14 associated with the table 13. The camming surface 36 preferably is generally concave as illustrated for accommodating the curved front edge of the rocker block 12 thereon. Stop block 30 is thereby slidably mounted on the base 14 as seen in FIG. 5. Outer leg 32 is formed with a front slot 40 and a rear slot 42 and said slots are adapted to slidably accommodate therethrough front and rear pins 41 and 43, respectively. The pins 41 and 43 are secured to the base 14 and serve to slidably retain the stop block 30 on the base. Outer leg 32 of the stop block 30 comprises an upwardly projecting segment 44 which terminates in a rearwardly projecting ear 46.

A stud 48 is secured to the stop block outer leg 32 at a position rearwardly of the front pin 41. A biasing spring 50 is connected between the front pin 41 and stud 48 to normally retain the stop block 30 in the inoperative position of FIGS. 2 and 7. One end of an actuating cable 52 is attached to a tensioning spring 54 which spring is in turn mounted to the stud 48. The opposite, or top end of the cable 52 is connected with a suitable swivel joint 56 to an edge of table 13. Suitable clips or brackets 58 support the cable 52 in the chair.

Operation of the invention in rocker/recliner 10 may now be appreciated by referring to the drawing figures in sequence. With chair 10 in the upright position of FIGS. 1 and 2 and with the table 13 in the inoperative concealed position, stop block 30 is spring-urged into the inoperative position and rocking motion is permissible and uninhibited. If the occupant proceeds to recline chair 10, the arresting members 16 and 18 are moved into operational position to prevent rocking. If the occupant first extends the table 13 while the chair is in the upright position, the movement of the cable 52 causes the stop block 30 to move to the operational position of FIG. 3 wherein the stop block cooperates with the rocker block 12 and front arresting member 18 to prevent forward and backward rocking. If the occupant now begins to recline, the front member 18 disengages from the ear 46 of the stop block and the arresting members 16 and 18 are actuated to prevent all rocking (FIG. 4). If the occupant abruptly leaves the chair and returns it to the upright position, the condition of FIG. 3 is automatically re-established. In any of the chair conditions described, table 13 may be collapsed to the stored, inoperative position in which case the stop block 30 is automatically returned to the inoperative position of FIGS. 1 and 2.

Figure 7:
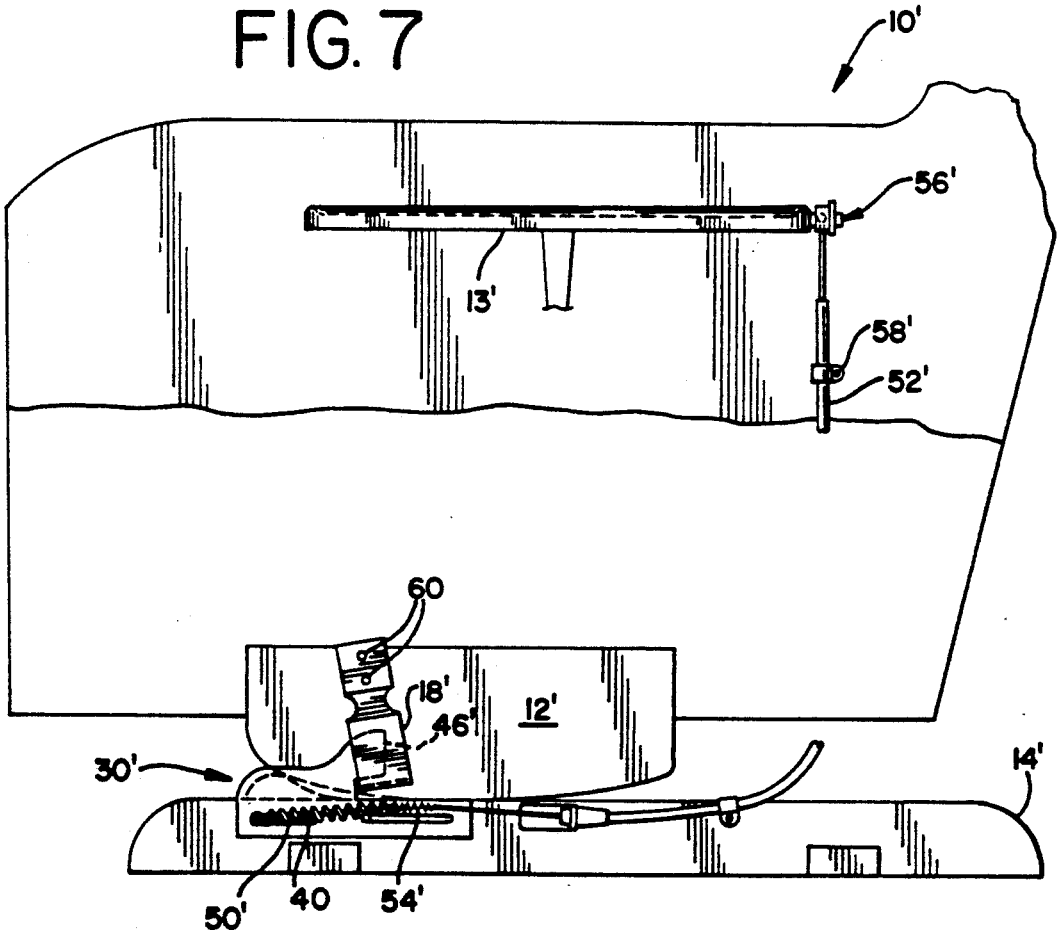
FIG. 7 is fragmentary side elevation showing the invention applied to a simple rocker chair.

In FIG. 7, there is illustrated application of the invention to a simple rocker chair 10', wherein like parts are designated by the same numerals with a prime superscript. Rocker chair 10' has no recliner capability and thus is devoid of reclining mechanism 15 and rear arresting member 16. However, front arresting member 18' is simply mounted directly to the rocker block 12 by means of screws or other suitable connectors 60. Operation of the chair 10' and stop block 30' for preventing rocking motion of the upright chair is the same as previously described.

From the foregoing description, it should be apparent that the invention provides a novel means for preventing rocking motion of a rocker or rocker/recliner when the chair is in the upright position, said means being automatically actuated when the table is extended to its operational position. It should also be understood that the language employed herein is for the purposes of description rather than limitation, and various changes can be made without departing from the spirit or scope of the invention which is defined in the appended claims.

What is claimed is:

1. In a rocker chair having a base member, rocker means cooperable with the base member and a table concealed in an arm of the chair and pivotable from a substantially vertical stored position to a substantially horizontal operative position, a stop block slidably mounted on said base member and normally retained in an inoperative position by resilient means so that rocking motion of the chair is unimpeded; and actuating means connected between said table and stop block whereby pivoting of said table into the operative position automatically slides said stop block into an operative position to arrest forward and backward rocking motion of the chair.

2. A rocker chair according to claim 1 comprising spring means connected to said block and normally urging the stop block into the inoperative position.

3. A rocker chair according to claim 2 wherein said actuating means comprises a cable connected at one end to said stop block and at the other end to a portion of said table so that extension of the table stretches said spring means and moves the stop block into the operative position.

4. A rocker chair according to claim 3 comprising a rocker block having a curved bottom surface resting on said base member, said stop block comprising a tapered camming surface adapted to wedge between said curved surface and base member to arrest forward rocking motion of the chair when the stop block is in the operative position.

5. A rocker chair according to claim 4 comprising a linkage reclining mechanism, front and rear arresting members pivotally connected to said mechanism and operable by the mechanism when the chair is reclined to bear against said base member to prevent forward and backward rocking motion, said stop block comprising an upstanding ear engageable with said front arresting mechanism to prevent backward rocking motion when the stop block is in the operative position and the chair is in the upright position.

6. A rocker chair according to claim 5 wherein said front arresting member comprises a depending L-shaped member having a bottom leg, said stop block ear engaging said bottom leg when the stop block is in the operative position and the chair is in the upright position.

7. A rocker chair according to claim 6 wherein reclination of the chair from the upright position disengages said bottom leg from said stop block and moves said leg into engagement with said base member.

8. A rocker chair according to claim 4 comprising a depending L-shaped member having a bottom leg secured to said rocker block, said stop block comprising an upstanding ear engageable with said bottom leg to prevent backward rocking motion when the stop block is in the operative position.

9. A rocker/recliner chair comprising:

a base member and a rocker block having an arcuate bottom surface rockably seated on said base member;

a linkage recling mechanism for moving the chair between the upright position and recline positions;

front and rear arresting members pivotally connected with said reclining mechanism and operable thereby to engage said base member and prevent forward and backward rocking motion when the chair is in a recline position;

a stop block slidably mounted on said base member and normally retained in an inoperative position by resilient means, said stop block being movable between the inoperative position and an operative position cooperable with said rocker block and said front arresting member to prevent forward and backward rocking motion of the chair when the chair is in the upright position;

a table concealed within an arm of the chair and extendible to an open position; and actuating means connected between said stop block and table for automatically moving said stop block into the operative position when the table is extended.

10. A rocker/recliner chair according to claim 9 wherein said stop block comprises a rearwardly tapering camming surface and an upstanding, rearwardly projecting ear, and spring means normally retaining said stop block in the inoperative position.

11. A rocker/recliner chair according to claim 10 wherein said front arresting member comprises a depending L-shaped member having a bottom leg, said camming surface adapted to wedge between said rocker block and base member and said ear adapted to engage said bottom leg.

12. A rocker chair comprising:

a base member and a rocker block having an arcuate bottom surface rockably seated on said base member;

a depending L-shaped member having a bottom leg secured to said rocker block;

a stop block slidably mounted on said base member and normally retained in an inoperative position by resilient means, said stop block being movable between the inoperative position and an operative position cooperable with said rocker block and said bottom leg to prevent forward and backward rocking motion of the chair;

a table concealed within an arm of the chair and extendible to an open position; and actuating means connected between said stop block and table for automatically moving said stop block into the operative position when the table is extended.

13. A rocker chair according to claim 12 wherein said stop block comprises a rearwardly tapering canning surface and an upstanding, rearwardly projecting ear, and spring means normally retaining said stop block in the inoperative position.

* * * * *